US005393255A

United States Patent [19]

Hisaoka et al.

[11] Patent Number: 5,393,255

[45] Date of Patent: Feb. 28, 1995

[54] METHOD OF INSPECTION FOR CATHODE-RAY TUBE COMPONENT MEMBERS AND APPARATUS USED FOR EMBODYING THE SAME

[75] Inventors: Yasushi Hisaoka; Yoshio Yamane; Hidenobu Murakami; Yoshimi Kinoshita; Hiroaki Tobuse; Kazuo Yoshida, all of Amagasaki; Takashi Ishii; Hiroshi Koizumi, both of Nagaokakyo, all of Japan

[73] Assignee: Mitsubishi Denki Kabushiki Kaisha, Tokyo, Japan

[21] Appl. No.: 202,773

[22] Filed: Feb. 28, 1994

[30] Foreign Application Priority Data

Mar. 1, 1993 [JP] Japan ..... 5-039892

[51] Int. Cl.[6] ..... H01J 9/42; H01J 9/20

[52] U.S. Cl. ..... 445/3; 445/63

[58] Field of Search ..... 445/3, 4, 63, 64

[56] References Cited

U.S. PATENT DOCUMENTS

| | | | |
|---|---|---|---|
| 4,405,950 | 9/1983 | Wardell | 445/3 X |
| 4,584,481 | 4/1986 | Matey | 445/63 X |
| 4,881,006 | 11/1989 | Hedrick | 445/3 X |

FOREIGN PATENT DOCUMENTS

| | | |
|---|---|---|
| 58-35445 | 3/1983 | Japan . |
| 60-160539 | 8/1985 | Japan . |
| 1-227331 | 9/1989 | Japan . |

*Primary Examiner*—Kenneth J. Ramsey

[57] ABSTRACT

An inspection method and an inspection apparatus for the component members of the cathode-ray tube are disclosed. An inspection apparatus composed of normal members other than an object of inspection is prepared at the time of inspecting the phosphor screen of the screen panel, the electron gun or the shadow-mask constituting the cathode-ray tube. In advanced to assembling the cathode-ray tube, the object of inspection is mounted on the inspection apparatus, so that the conformance or rejection of the object of inspection is decided from the illuminated condition of the phosphor screen by irradiating electron beams thereon.

20 Claims, 10 Drawing Sheets

METHOD OF INSPECTION FOR CATHODE-RAY TUBE COMPONENT MEMBERS AND APPARATUS USED FOR EMBODYING THE SAME

BACKGROUND OF THE INVENTION

1. Field of the Invention

The present invention relates to a method and an apparatus for inspecting a phosphor screen of a panel, an electron gun or a shadow-mask making up members of a cathode-ray tube in the processes of manufacturing the cathode-ray tube.

2. Description of Related Art

A phosphor screen of a cathode-ray tube is generally fabricated by forming a thin film of phosphor material on an inner surface of a panel glass and forming a metal thin film called a metal-back thereon. The metal-back is intended to prevent a phosphor screen from being charged by an electron beam irradiated from the electron gun on the one hand and to improve the brightness by reflecting the light emitted from the phosphor material toward the front of the panel face on the other. The metal-back, which is typically formed to have the thickness of about several hundred nm in such a manner as to allow the transmission of a sufficient quantity of electron beam to excite the phosphor material, is made of aluminum in many cases.

Now, defects of the cathode-ray tube are often caused duping the manufacturing process of the phosphor screen. The dropout of the phosphor film or the metal-back, if any, constitutes a direct cause of the screen defect. The improper or uneven film thickness, if not the dropout, leads to brightness irregularities causing a deteriorated screen brightness. Also, an unsatisfactory preparation of the phosphor material of course results in a failure to secure an illumination of predetermined chromaticity. As described above, the process for fabricating the phosphor screen requires utmost attention, and the inspection of the quality of the phosphor screen thus fabricated is an indispensable process for quality control.

The inspection of the phosphor screen plays an important role in the manufacture of the color picture tube of all the cathode-ray tubes. In a color picture tube for the typical home-use television receiver, for example, three types of phosphor materials for emitting the three primary colors of green, blue and red are arranged in stripes on the phosphor screen. These three phosphor materials are impinged upon by three electron beams independently of each other thereby to form an image of an arbitrary chromaticity and brightness. A shadow-mask is arranged at the intersection of the tracks of the three electron beams. The shadow-mask has a multiplicity of apertures corresponding to respective phosphor pixels making up the phosphor screen, so that the expansion of the electron beams emitted from the electron gun and bombarding the phosphor screen is limited and the appropriate color is selected by the incident angle of the three electron beams entering the apertures. Further, in order to prevent the entrance of the electron beams into adjacent phosphor pixels and thus to improve the image contrast, a black matrix made of light-absorbing black-body film is inserted in the clearances between the phosphor pixels. The black matrix is formed through the processes of applying resist, exposure, development, applying graphite, etching and development in that order. The phosphor film, on the other hand, is formed by repeating the processes of applying slurry, exposure and development for each color.

As described above, the phosphor screen of the color picture tubes which has a complicated construction and complicated fabricating processes construction as compared with the monochromatic cathode-ray tube, requires a quality control procedure based on the proper inspection methods in view of the fact that defects peculiar to the color picture tube would present themselves such as the mixed colors on the screen which might be caused from a dimensional error of the phosphor screen pattern.

The conventional methods of inspecting the phosphor screen are roughly of two types. One is the inspection of the final products, in which after the cathode-ray tube is completed as a bulb through all the manufacturing processes, the electron beams drawn from the electron gun sealed in the bulb are irradiated for scan on the phosphor screen, while observing the illumination in the process.

The second method is such that after forming the phosphor screen on the inner surface of the panel glass, light is irradiated on the phosphor screen to observe the illumination or the light transmitted through the phosphor screen. The phosphor screen inspection method disclosed in Japanese Patent Application Laid-Open No. 58-35445 (1983), for example, causes the phosphor screen to illuminate by irradiating the ultraviolet ray from a source like the black lamp on the panel formed on the phosphor screen thereby to detect the presence or absence of a defect of the phosphor material. In the method of inspecting the phosphor screen disclosed in Japanese Patent Application Laid-Open No. 1-227331 (1989), on the other hand, the white light of a high-pressure mercury lamp is irradiated from the back of the panel formed on the phosphor screen. This method is intended for detecting a defect by observing the transmitted light taking advantage of the fact that the light transmittivity is higher for the portion lacking the phosphor material or the metal-back.

In addition to the phosphor screen inspection described above, the inspection of the shadow-mask and the electron gun is a process indispensable for assuring the quality control in the manufacture of the cathode-ray tube. The shadow-mask, after press-formed, is checked for the workmanship, irregularities and appearance of the curved surfaces and is mounted on the panel. The electron gun, on the other hand, are assembled after inspection for dimensional accuracy of each unit of the electrode parts, and through the inspection of assembly accuracy including the inter-electrode distance, is sealed in the tube. The characteristic inspection of the shadow-mask and the electron gun is carried out as an item of the final product inspection after the cathode-ray tube is completed as a bulb.

The aforementioned conventional methods of inspecting the component parts of the cathode-ray tube including the panel phosphor screen, the shadow-mask or the electron gun poses the problems described below.

First, in the method of inspection conducted by causing the phosphor screen to illuminate after completing the cathode-ray tube as a bulb, the problem is posed that the inspection is possible only after a number of processes including the attaching the panel and the funnel, sealing the electron gun, exhausting the tube interior, the vacuuming and aging of the cathode, following the forming of the phosphor screen on the panel. As a result, in the event of an unexpected defective process of forming the phosphor screen, a long time is taken before discovery of the defect by inspection. All the bulbs charged in the production line in the process are unavoidably discarded as defective products, thereby leading to a great loss. This is not limited to the phosphor screen alone, but a very serious problem is caused similarly in the case where a defect is discovered during the manufacture of the electron gun or the shadow-mask as well.

Also, even if a defect is discovered by the screen inspection on a completed bulb, the job of specifying the defective component member causing the particular defect is a long, tedious one, thereby making it difficult to take a remedial action promptly.

In the method of observing the illumination or the transmission of the light irradiated on the panel forming the phosphor screen, on the other hand, the inspection can be carried out immediately after the process of forming the phosphor screen. This method is therefore superior to the above-mentioned method in that a defect is detectable at an earlier time, but has the disadvantage that the inspection items are considerably limited. In other words, according to the method of inspection by light irradiation, in which the electron beam is not actually irradiated, it is difficult to evaluate the quality of brightness, chromaticity, illumination uniformity, etc. under the conditions of the rated operation of a completed bulb. The use of this method is thus limited to the discovery of limited types of defects such as the lack of phosphor material or a clogged shadow-mask. Also, with regard to the electron gun, there is no other effective means than the appearance inspection to perceive the lack of phosphor material before completion of the bulb, thus making it difficult to detect defects of the electron emission characteristic at an earlier time.

SUMMARY OF THE INVENTION

The invention has been made to solve the above-mentioned problems, and the object of the invention is to provide an inspection method and an inspection apparatus used for carrying out the method, in which the objects of inspection including the shadow-mask, the electron gun and the phosphor screen formed on the screen panel of the cathode-ray tube can be inspected independently of each other over a wide range of inspection items like the final product inspection without proceeding through the subsequent manufacturing steps.

According to one aspect of the invention, there is provided an inspection method for the component members of the cathode-ray tube, wherein the electron gun is arranged in an inspection housing which the screen panel as an object of inspection is mountable on and demountable from, and which is adapted to be enclosed by the mounting of the screen panel thereon prior to completion of the cathode-ray tube, the screen panel being thus mounted with the electron beam irradiated the phosphor screen of the screen panel thereby to decide on the quality of the screen panel, the inspection apparatus comprising, in addition to the inspection housing and the electron gun, a deflection yoke for scanning the electron beam on the phosphor screen and means for exhausting the air from the inspection housing.

According to another aspect of the invention, there is provided an inspection method for the component members of the cathode-ray tube, wherein an electron gun is arranged in an inspection housing which the electron gun as an object of inspection is mountable on and demountable from and which is adapted to be enclosed by the mounting of the screen panel thereon prior to the completion of the cathode-ray tube, so that the electron beam is irradiated on the phosphor screen of the screen panel to decide the quality of the electron gun, the inspection apparatus comprising the inspection housing, the screen panel, a deflection yoke for causing the electron beam to scan the phosphor screen, and means for exhausting the interior of the inspection housing.

According to still another aspect of the invention, there is provided an inspection method for the component members of the cathode-ray tube, wherein the shadow-mask is mounted on an inspection housing the interior of which the shadow-mask as an object of inspection is mountable in and demountable from and which is adapted to be enclosed with the electron gun and the screen panel prior to the completion of the cathode-ray tube, and phosphor screen of the screen panel is irradiated with the electron beams to decide the quality of the shadow-mask, the inspection apparatus comprising the inspection housing, the electron gun, the screen panel, a deflection yoke for causing the electron beams to scan the phosphor screen, and means for exhausting the interior of the inspection housing.

According to a further aspect of the invention, there is provided an inspection method and an inspection apparatus for the component members of the cathode-ray tube, wherein the screen panel is mounted on the inspection housing when the screen panel is an object of inspection, and the electron gun or the shadow-mask is mounted similarly when the electron gun or the shadow-mask is an object of inspection, respectively, and the electron beams are irradiated on the phosphor screen of the screen panel thereby to conduct the inspection of the object. In the case where the screen panel is an object of inspection, for example, the screen panel that has passed the process of forming the phosphor screen is mounted on the inspection apparatus, and the electron beams emitted from the electron gun arranged in the inspection apparatus are irradiated for scanning the phosphor screen, so that the condition of an image illuminated with the electron beams as an excitation source is realized in the same way as in a complete bulb of the cathode-ray tube. This image is observed to decide on the quality of the screen panel.

According to a still further aspect of the invention, there is provided an inspection method for the component members of the cathode-ray tube, wherein a plurality of electron beams are irradiated on the phosphor screen. As a result, the phosphor materials are bombarded independently for each illumination color thereby to display an inspection image of an arbitrary pattern with an arbitrary chromaticity or brightness.

According to yet another aspect of the invention, there is provided an inspection method for the component members of the cathode-ray tube, with the shadow-mask as an object of inspection, wherein the phosphor screen of the screen panel is made of a monochromatic phosphor material. As a consequence, an inspection image is displayed on the phosphor screen formed of a single type of phosphor material, thereby making it possible to display a defect of the shadow-mask as a brightness irregularity on the inspection screen.

According to another aspect of the invention there is provided an inspection apparatus for the component members of the cathode-ray tube, with the phosphor screen or the electron gun as an object of inspection, wherein the phosphor screen is formed of a plurality of types of phosphor materials, the apparatus comprising a shadow-mask for irradiating the electron beams on a predetermined phosphor material. As a result, the component member as an object of inspection can be inspected from the illumination characteristic of a predetermined type of phosphor material.

According to still another aspect of the invention, there is provided an inspection apparatus for the component members of the cathode-ray tube, with the phosphor screen, the electron gun or the shadow-mask as an object of inspection, further comprising means for moving the electron gun. The position of the electron gun relative to the screen panel is regulated to adjust the position of the phosphor screen irradiated by the electron beams. In the case where there are a plurality of electron beams, the intervals between the points on the phosphor screen reached by the electron beams can be changed. Even on the phosphor screen with different pitches of phosphor materials, therefore, an inspection image free of color mixture can be produced.

According to a further aspect of the invention, there is provided an inspection apparatus for the component members of the cathode-ray tube, with the phosphor screen or the shadow-mask as an inspection object, further comprising a partition member insertable between the electron gun and the screen panel so as to seal the electron gun within the inspection housing. As a result, at the time of replacing the screen panel or the shadow-mask the electron gun area in the inspection housing is enclosed by the partition member thereby to shield the electron gun from the atmosphere. It is thus possible to suppress the deterioration of the electron emission capacity of the electron gun which otherwise might be caused by moisture attached thereto or oxidization.

According to a yet further aspect of the invention, there is provided an inspection apparatus for the component members of the cathode-ray tube, with the phosphor screen, the electron gun or the shadow-mask as an object of inspection, wherein the inspection housing on which the inspection object is mountable and demountable includes a funnel for the cathode-ray tube. As a result, the arrangement of the screen panel and the funnel is equivalent to that of the normal cathode-ray tube in complete form, and the electron gun and the deflection yoke are dimensionally and functionally compatible with the members used for the actual cathode-ray tube.

The above and further objects and features of the invention will more fully be apparent from the following detailed description with accompanying drawings.

DESCRIPTION OF THE PREFERRED EMBODIMENTS

The invention will be described in detail below with reference to the drawings showing embodiments thereof.

First Embodiment

Figure 1:
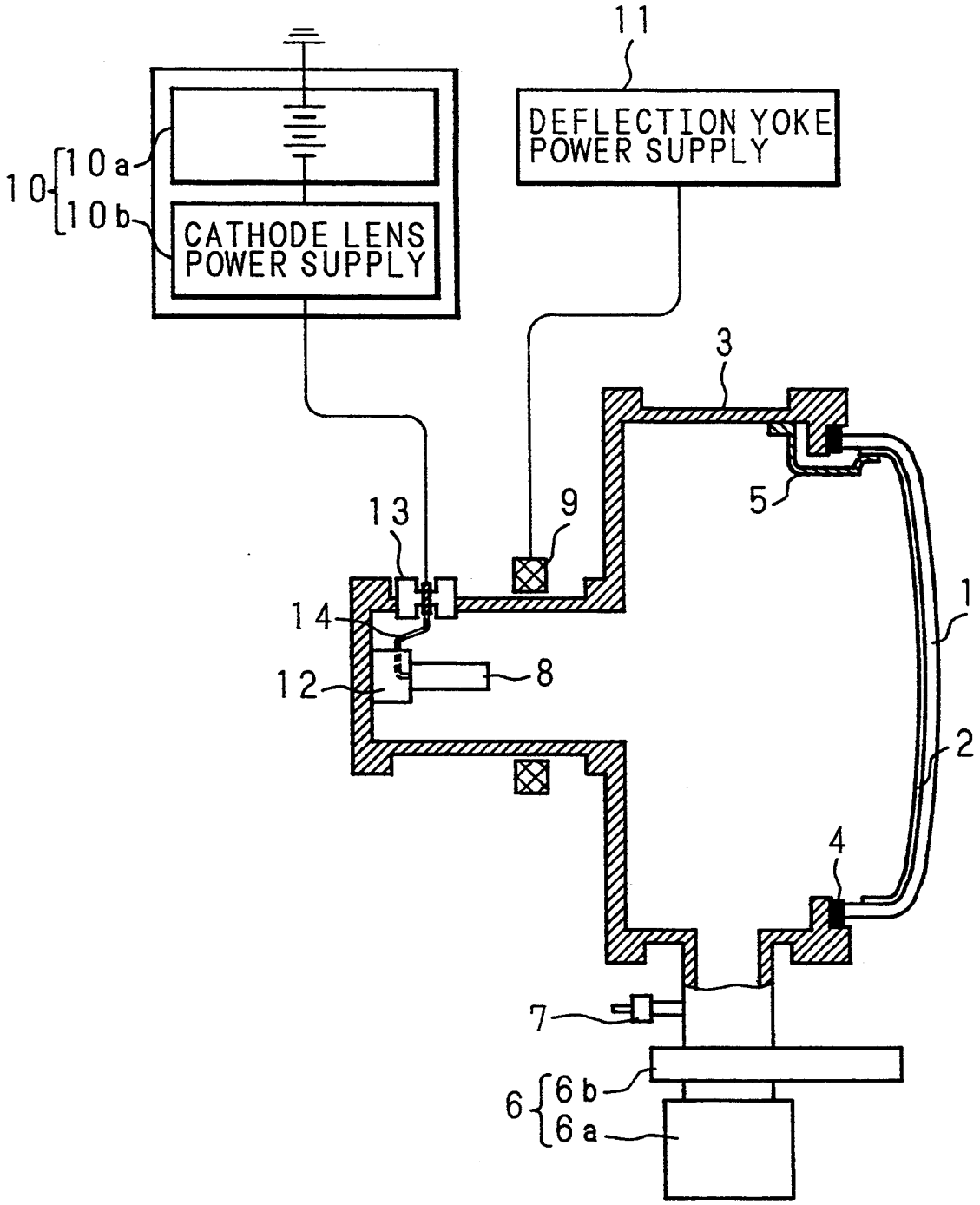
FIG. 1 is a schematic sectional view showing a first embodiment of the invention.

FIG. 1 is a schematic sectional view showing a configuration of the inspection apparatus according to a first embodiment of the invention. In FIG. 1, numeral 1 designates a panel to be inspected, with a phosphor screen 2 formed on the inner surface of the panel 1. A housing 3 is made of stainless steel, for instance, and includes a panel mounting/demounting unit with an opening of substantially the same size as the panel 1 and a cylindrical electron gun arrangement protruded on the side opposite to the opening of the panel mounting-/demounting unit. The panel 1 is mounted on the housing 3 in such a manner as to hold the phosphor screen 2 against the opening of the housing 3 through a gasket 4 made of, say, rubber attached to the front opening of the housing 3, thereby maintaining the vacuum hermeticity. A shorting plate 5 made of a spring plate is mounted on the opening of the housing 3, and is adapted to come into contact with the phosphor screen 2 at the time of mounting the panel 1. The shorting plate 5 moves the electrons entering the phosphor screen 2 toward the earth thereby to prevent the charging of the phosphor screen. The exhaust means 6 coupled to the housing 3 includes a pump **6*a* and a gate valve 6*b* to exhaust the interior of the housing 3. A leakage valve 7 coupled to the housing 3 is used for opening the interior of the housing 3** to the atmosphere.

Also, the electron gun 8 for generating the electron beams is supported on a socket 12 made of an insulating material like ceramics fixed on the electron gun arrangement of the housing 3 and is arranged in such a manner as to irradiate the electron beams toward the panel 1. The electron gun includes cathodes for emitting the electron beams and an electron lens section for focusing the electron beam by controlling the current quantity of the electron beams. The electron gun 8 is supplied with electric current by a wiring member 14 from an electron gun power supply 10 through a lead terminal 13 in the housing 3. The electron gun power supply 10 includes an electron beam acceleration power supply **10*a* and a cathode lens power supply 10*b* connected in floating state with the output of the electron beam acceleration power supply 10*a*. A deflection yoke 9 is arranged on the outer periphery of the electron gun arrangement in the housing 3 to perform the scanning operation of the electron beams with power supplied from the deflection yoke power supply 11**.

In the phosphor screen inspection apparatus constructed as above, at first, the panel 1 to be inspected, that has passed the process of forming the phosphor screen, is mounted on the opening of the housing 3. Next, the exhaust means 6 is activated to exhaust the interior of the housing 3 to a high vacuum. When the vacuum pressure high enough to activate the electron gun 8 is reached, electrons are emitted from the electron gun 8 by the power supplied from the electron gun power supply 10. The electrons emitted from the cathodes of the electron gun 8 are accelerated and focused by the electron lens thereby forming electron beams.

The current and the beam diameter of the electron beams are set to predetermined inspection conditions by adjusting the output voltage of the cathode lens power supply 10*b*. The electron beams thus formed are irradiated for scanning by the deflection yoke 9 to illuminate the whole effective region of the phosphor screen 2. An illuminated image is thus observed from the panel front to check for the quality of the phosphor screen. Upon completion of the inspection, the power from the electron gun power supply 10 is cut off to stop the irradiation of the electron beams, and the gate valve 6*b* is closed to stop the operation of the exhaust means 6, and after that the leak valve 7 is opened to expose the interior of the housing 3 to the atmospheric pressure. The panel that has been inspected is removed and is replaced with the next panel to be inspected.

In the case where inspection of the phosphor screens of plural types of panels different in size and shape is necessary using the apparatus according to this embodiment, a plate member associated with the opening constituting the members of the housing 3, is constructed to be removable from the housing. As a result, each time the panel type is changed, the plate member is replaced with the one with a suitable opening, thus making it possible to inspect the phosphor screens of plural types of panels different in size and shape.

According to this embodiment, with regard to the phosphor screen of the cathode-ray tube operated by monochromatic illumination like the monochrome picture receiver, an illuminated image equivalent to that on a complete bulb is obtained even for the inspection immediately after the process of forming the phosphor screen.

Although the foregoing description concerns the case in which the panel is mounted on the opening of the housing through a gasket, the method of mounting is not limited to that of this embodiment as long as the panel can easily to be replaced. For example, the housing may include a panel delivery port with an openable door and a peep hole of glass or the like, so that the panel can be delivered in by way of the panel delivery port and the illuminated image on the phosphor screen can be observed through the peep hole.

Second Embodiment

Now, the invention will be specifically explained with reference to the drawings showing a second embodiment thereof.

In the case where the phosphor screen of the color picture tube is inspected under the construction shown in the first embodiment, for example, the electron beams irradiated for scanning are impinged on all the phosphor materials of green, blue and red to illuminate the phosphor screen substantially in white. When it is necessary to inspect the illumination characteristic of a particular phosphor material, therefore, the shadow-mask is mounted on the inspection panel like the actual color picture tube to protect the phosphor materials of the remaining colors from the bombardment of the electron beam for inspection. A related embodiment is explained below.

Figure 2:
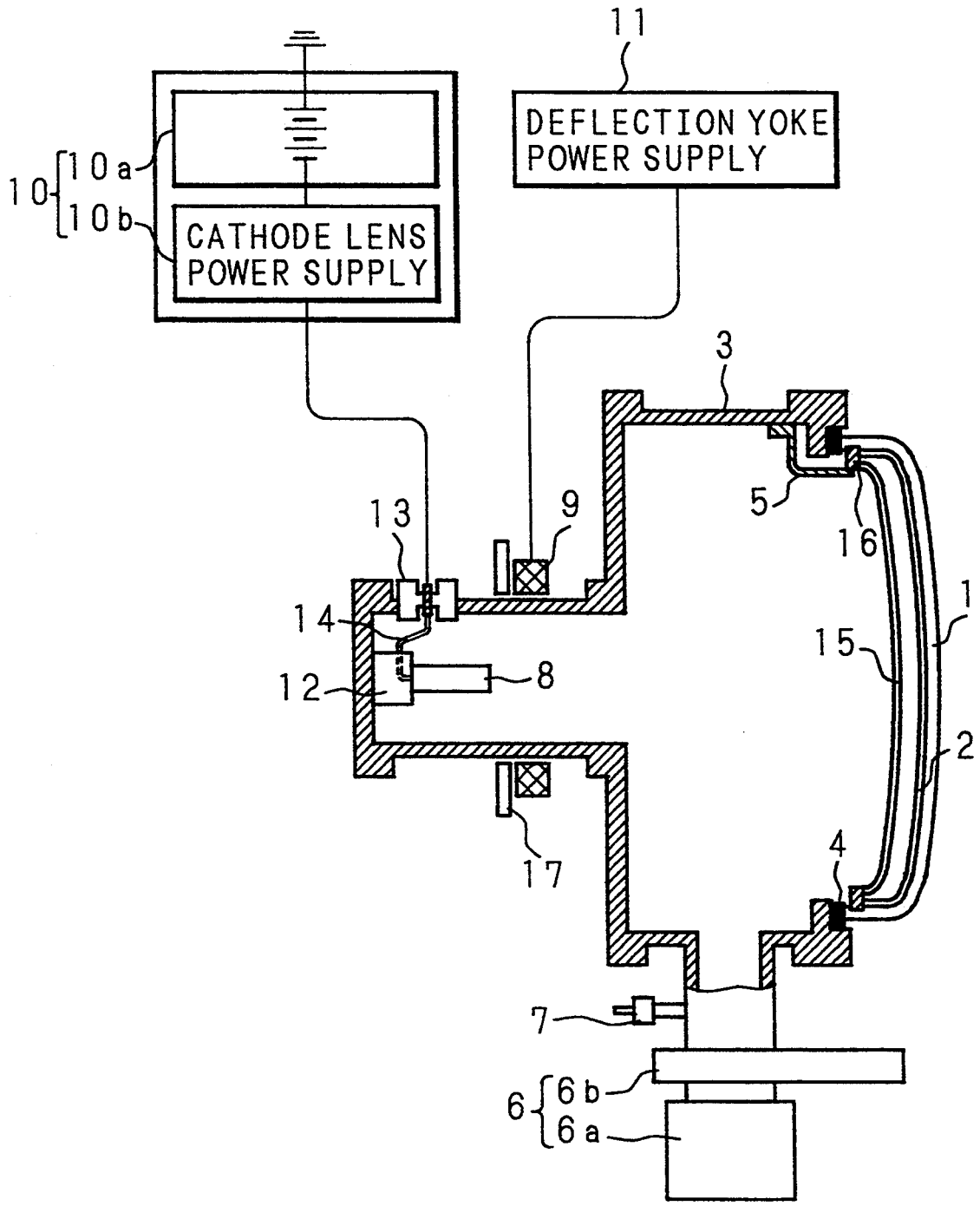
FIG. 2 is a schematic sectional view showing a second embodiment of the invention.

FIG. 2 is a schematic sectional diagram showing a configuration of the inspection apparatus according to the second embodiment of the invention. In FIG. 2, numeral 1 designates a panel as an object of inspection fabricated for the color picture tube, which is formed with a phosphor screen 2 of three types of phosphor materials and a black matrix on the inner surface thereof. A shadow-mask 15 is mounted using panel pins 16 on the inner side of the panel 1. The panel 1 and the shadow-mask 15 are mounted on the housing 3 in such a position as to maintain vacuum hermeticity with the shadow-mask 15 opposed to the opening of the housing 3 through a gasket 4 made of, say, rubber attached on the opening. The shadow-mask 15 is electrically connected to the phosphor screen 2 through the panel pins 16, and further electrically grounded to the housing 3 by means of a shorting plate 5. The embodiment uses the shadow-mask 15 mounted in the actual color picture tube.

A deflection yoke 9 is arranged at such a position that the intersection of a plurality of straight lines connecting the center of each pixel of the phosphor screen and the center of the corresponding aperture of the shadow-mask 15 coincides with the optical deflection center of the deflection yoke 9. A purity correcting magnet 17 made up of a plurality of permanent magnets or multipole electromagnets is arranged on the side in opposed relation to the panel 1 concentrically with the deflection yoke 9. The purity correcting magnet 17, like the one mounted in the actual color picture tube, has a function of correcting the electron beam emission angle from the cathodes by the operation of the dipole components of the magnetic field. The other component elements and functions are similar to the corresponding ones of the first embodiment and will not be explained.

Figure 3:
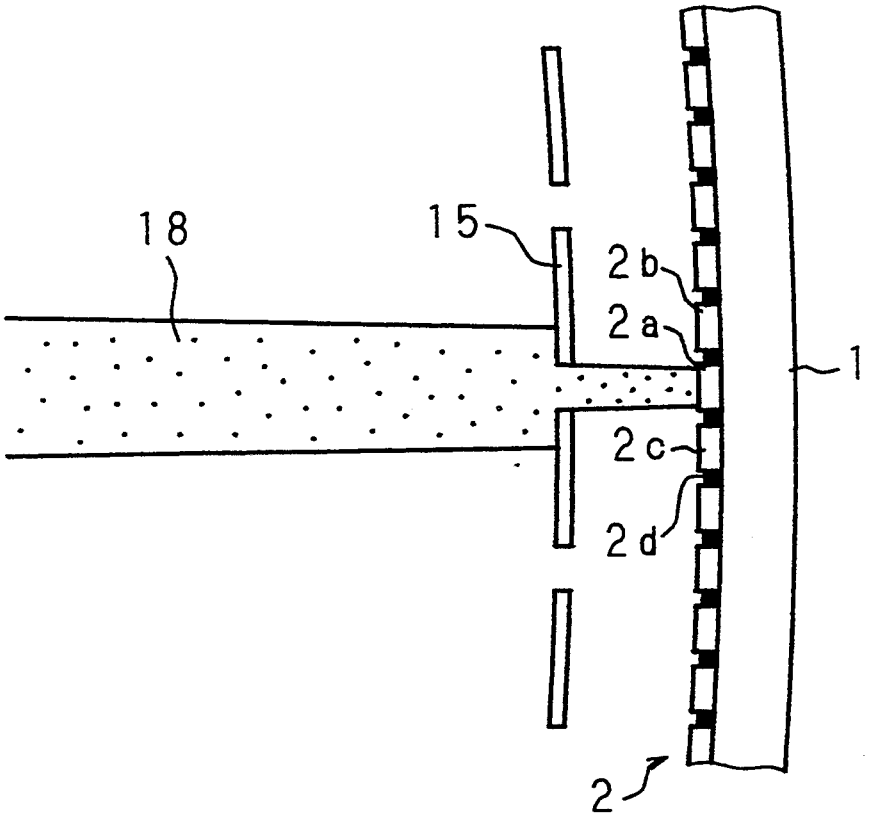
FIG. 3 is a schematic diagram showing the manner in which the electron beams are irradiated on the panel and the shadow-mask according to the second embodiment of the invention.

In the case where an electron beam is formed in accordance with the procedure similar to that for the first embodiment using an apparatus configured as described above, a part of the electron beam is shut off by the shadow-mask 15 and only that part of the electron beam which has passed the aperture reaches the phosphor screen. FIG. 3 is a schematic diagram showing the manner in which the electron beam is irradiated on the panel 1 and the shadow-mask 15. In FIG. 3, numeral 18 designates the electron beam, which after passing through the aperture of the shadow-mask, is irradiated on the phosphor screen 2 formed on the panel 1. The phosphor screen 2, as described above, includes a green illuminating phosphor material 2*a*, a blue illuminating phosphor material 2*b*, a red illuminating phosphor material 2*c* and a black matrix 2*d*.

FIG. 3 shows a case in which the incident angle of the electron beam 18 is adjusted by a purity correcting magnet 17 to enable the electron beam 18 to arrive at the surface of the green illuminating phosphor material 2*a*. The expansion of the electron beam 18 reaching the phosphor screen 2 is limited by the shadow-mask 15, and therefore only the green illuminating phosphor material 2*a* is bombarded without impinging on the blue illuminating phosphor material 2*b* or the red illuminating phosphor material 2*c* adjacent thereto. Further, the deflection yoke 9 is arranged in such a position as to align the deflection center, each pixel center and each aperture of the shadow-mask on a straight line. The electron beam 18, in scanning operation, therefore, reaches the surface of the green illuminating phosphor material 2*a* after passing through any aperture of the shadow-mask 15.

As described above, according to the embodiment, the electron beam 18 bombards only the green illuminating phosphor material 2*a* during the scanning of the phosphor screen 2. Thus a green illuminated image is displayed on the panel surface, thereby making it possible to inspect the illumination characteristic of the green illuminating phosphor material 2*a* alone.

Although the inspection method for the green illuminating phosphor material 2*a* is explained as an example according to the second embodiment, the invention is not confined to such a case. Instead, the phosphor materials 2*b* and 2*c* illuminating the blue and red colors respectively can be inspected in similar fashion, as long as the incident angle of the electron beam 18 to the shadow-mask 15 is changed by adjusting the purity correcting magnet 17 or the relative positions between the panel 1 to be inspected and the electron gun 8.

Apart from the inspection of the phosphor screen of the panel as in the second embodiment described above, the electron gun or the shadow-mask may alternatively be arranged as an object of inspection for conducting a similar inspection with the remaining normal component parts.

In the case where the shadow-mask is to be inspected, the shadow-mask 15 is arranged as an object of inspection in the manner as shown in FIG. 2, and the electron beam drawn from the normal electron gun 8 is irradiated through the shadow-mask 15 on the normal phosphor screen 2 thereby to display an inspection image. By observing this image, the shadow-mask is checked for defectiveness. In the case where the phosphor screen 2 used is formed of a monochromatic phosphor material of any of red, green or blue, a defect is easy to judge because the defect can be confirmed as a brightness irregularity in the inspection image.

For inspection of an electron gun, on the other hand, the particular electron gun 8 is arranged as an object of inspection as shown in FIG. 2, and the electron beam drawn from the electron gun 8 is irradiated on the phosphor screen of the normal panel thereby to display an inspection image, so that a defect, if any, due to the dimensional error occurred during the processing or assembly of the electron gun is judged on the screen.

Third Embodiment

Now, a third embodiment of the invention is explained below with reference to the related drawing.

According to the second embodiment described above, a single electron beam is irradiated to illuminate and scan the phosphor material of green, blue or red on the phosphor screen of the Color picture tube so that the screen is illuminated monochromatically in green, blue or red to perform the inspection of the illumination characteristic of each phosphor material individually. In the case where inspection of the composite chromaticity or contrast of the image is necessary, however, the three electron beams are bombarded simultaneously on the phosphor materials of green, blue and red on the phosphor screen to conduct the inspection in such a manner as to realize the image-forming function equivalent to that of a completed product of the actual color picture tube. The embodiment for that purpose is explained below.

Figure 4:
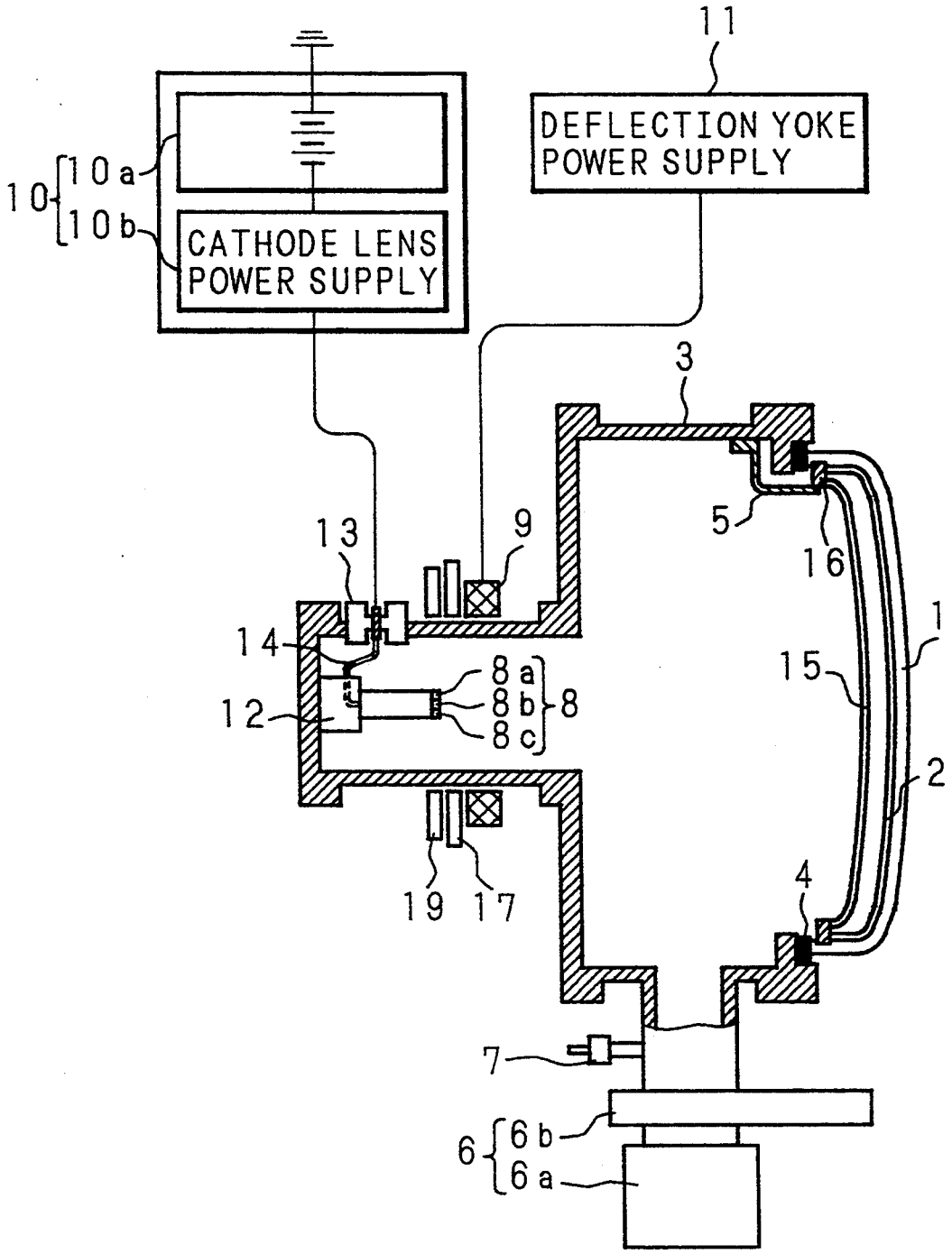
FIG. 4 is a schematic sectional view showing a third embodiment of the invention.

FIG. 4 is a schematic sectional view showing a configuration of the apparatus according to the third embodiment of the invention. In FIG. 4, numeral 1 designates a panel constituting an object of inspection fabricated for the color picture tube. This panel has formed on the inner surface thereof a phosphor screen 2 made up of three types of phosphor materials and a black matrix. A shadow-mask 15 is formed using panel pins 16 on the inner side of the panel 1. The panel 1 and the shadow-mask 15 are mounted on the housing 3 with the shadow-mask 15 positioned in such a way as to maintain vacuum hermeticity in opposed relation to an opening. The embodiment uses the shadow-mask 15 actually mounted on the color picture tube.

The electron gun 8 includes three cathodes 8*a*, 8*b*, 8*c* similar to those of the electron gun sealed in the actual color picture tube. A plurality of permanent magnets or a multi-pole electromagnet make up a convergence correcting magnet 19, which is arranged in opposed relation to the panel 1 concentrically with a purity correcting magnet 17. The convergence correcting magnet 19, like the one mounted in the actual color picture tube, is used in combination with the purity correcting magnet 17, and has a function of correcting the emission angle of the three electron beams independently of each other as emitted from the three cathodes by the operation of the dipole component, the quadrupole component and hexapole component of the magnetic field. The other component elements and functions of the embodiment are similar to those of the first embodiment respectively and will not described.

Figure 5:
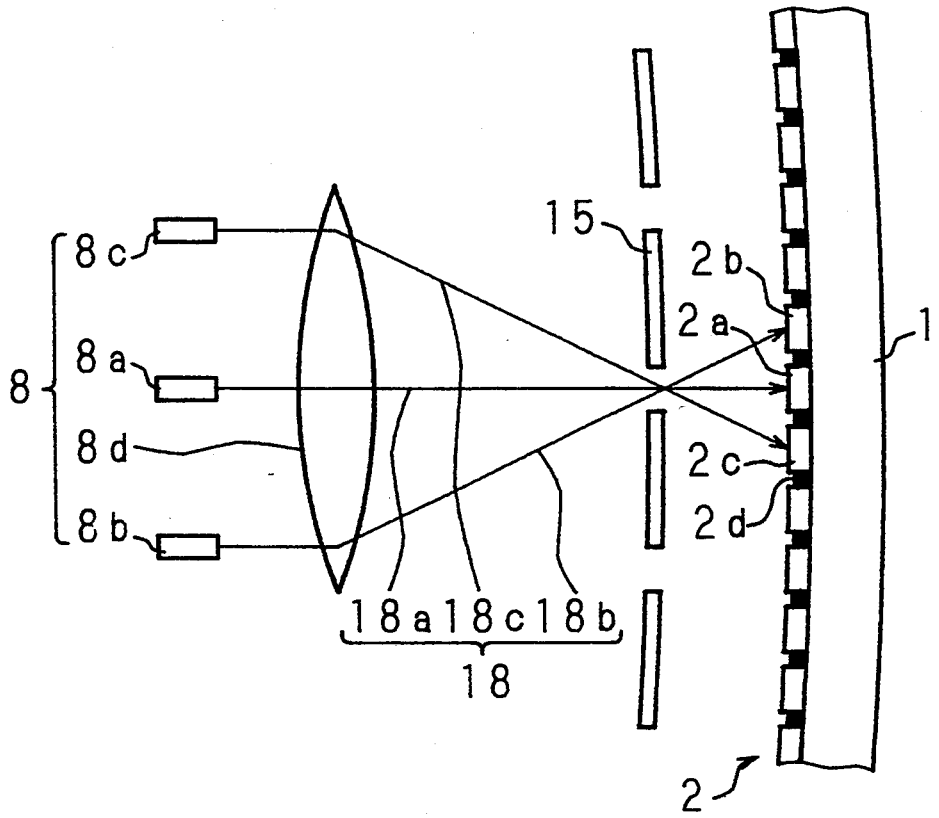
FIG. 5 is a schematic diagram showing the manner in which the electron beams are irradiated according to the third embodiment of the invention.

In the case where electron beams are formed in accordance with the procedure similar to that of the second embodiment using the apparatus having the above-described configuration, the three electron beams are drawn from the electron gun. FIG. 5 is a schematic diagram showing the manner in which the electron beams are irradiated on the panel 1 and the shadow-mask 15. In FIG. 5, numerals 8*a*, 8*b*, 8*c* designate three cathodes of the electron gun 8. The electron beams 18*a*, 18*b*, 18*c* are emitted from the three cathodes 8*a*, 8*b*, 8*c* and are focused by the electron lens 8*d* of the electron gun 8. These electron beams 18*a*, 18*b*, 18*c* intersect each other at the center of the aperture of the shadow-mask 15 by adjusting the purity correcting magnet 17 and the convergence correcting magnet 19 thereby to individually bombard the phosphor materials 2*a*, 2*b*, 2*c* adapted to illuminate in green, blue and red respectively. This process of operation is indeed equivalent to the condition realized during the operation of the actual color picture tube. As a result, by performing the scanning operation of the three electron beams 18 through a deflection yoke 9 collectively and controlling the current amount thereof independently of each other, an image of an arbitrary pattern having an arbitrary chromaticity and brightness can be displayed on the panel surface. This image is observed to inspect the phosphor screen.

Although the third embodiment concerns the case in which the phosphor screen 2 of the panel is inspected, the invention is not limited to such an application but may use the electron gun 8 or the shadow-mask 15 as an object of inspection arranged as shown in FIG. 4, with the remaining normal component parts.

Fourth Embodiment

Now, the fourth embodiment of the invention will be explained specifically with reference to the accompanying drawings.

When an image-forming function equivalent to that of the actual color picture tube is to be achieved in the third embodiment, as shown in FIG. 5, it is necessary to cause the main light rays of three electron beams to intersect at the center of the shadow-mask aperture and to accomplish what is called the "perfect landing" in which the phosphor materials for illuminating in green, blue and red are individually bombarded. The purity correcting magnet and the convergence correcting magnet have a function of compensating for the displacement of the electron beams from the tracks thereof attributable to the working error of the electron gun, etc. In some cases, however, the relative positions between the electron gun and the phosphor screen fail to be reproduced at the time of mounting the object member for inspection, thus exceeding the limit of compensation by the purity correcting magnet and the convergence correcting magnet. In such cases, a mechanism for moving the electron gun is required to restore the panel and the electron gun to the normal relative positions.

Also, phosphor screens of many different types of tubes having different pitches of phosphor materials can be implemented with a single electron gun by adjusting the relative positions of the panel and the electron gun. For example, when the electron gun is located far away from the panel and the intensity of the focusing lens is adjusted to permit the three electron beams to cross at the position of the shadow-mask aperture, the interval between the points of arrival of the three electron beams on the phosphor screen is shortened, thereby achieving the perfect landing adapted to the phosphor screen having a narrow pitch between the phosphor materials.

An embodiment comprising means for moving the electron gun will be explained below.

Figure 6:
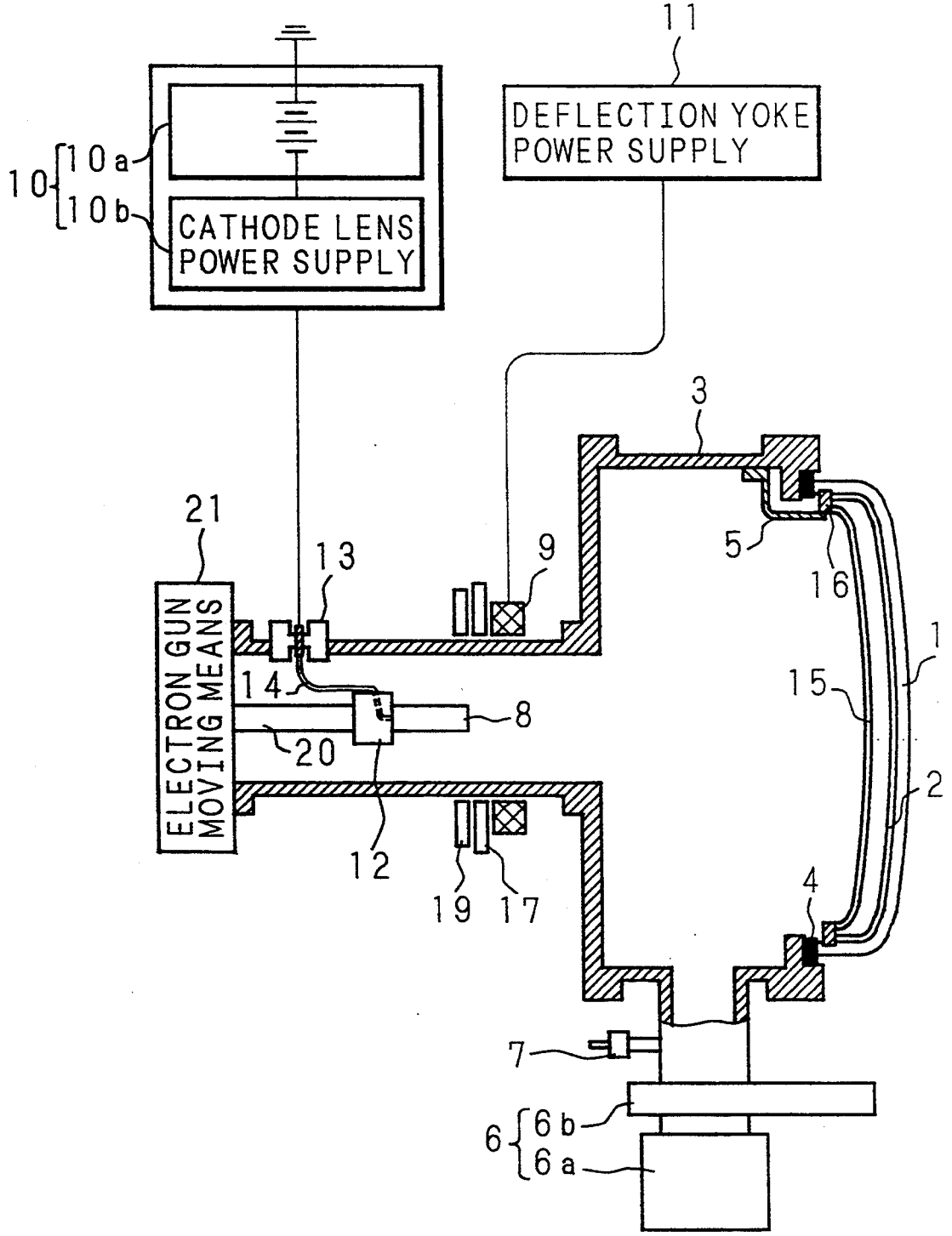
FIG. 6 is a schematic sectional view showing a fourth embodiment of the invention.

FIG. 6 is a schematic sectional view showing a fourth embodiment of the invention. Electron gun moving means 21 is mounted on the back of the housing 3 on the side thereof near to an electron gun arrangement. The electron gun moving means 21 has an end thereof connected to a cylindrical shaft 20 in the housing 3, and the other end of the shaft 20 is fixed with a socket 12 to support the electron gun 8. The shaft 20 is extensible along the direction of irradiation of the electron beams, whereby the electron gun 8 is movable.

Figure 7:
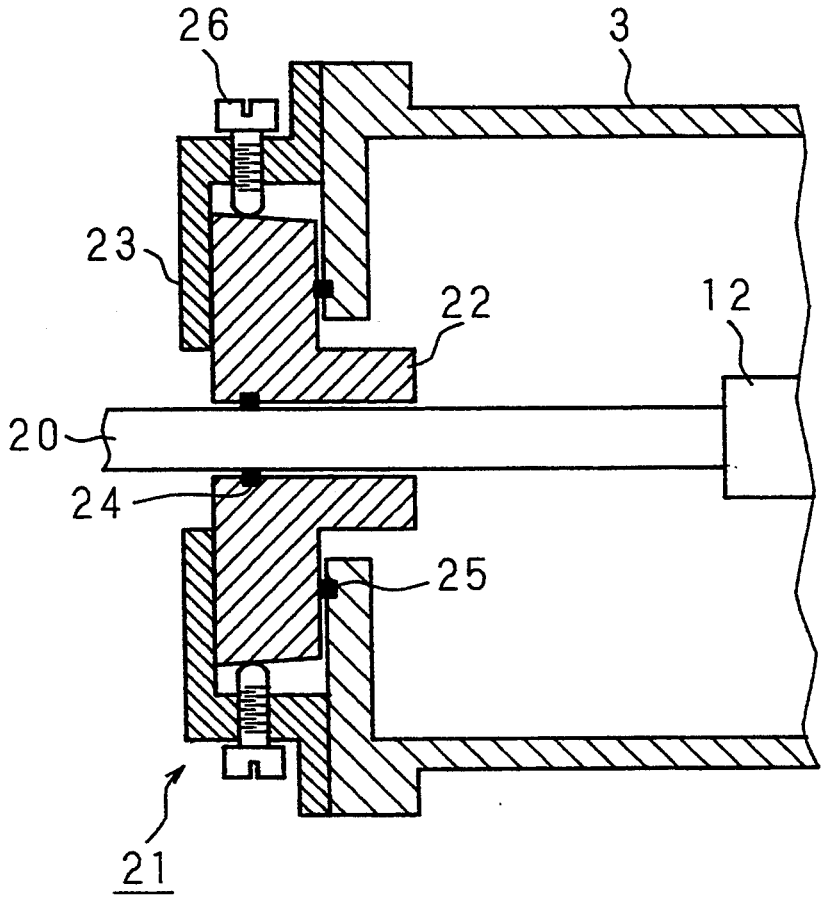
FIG. 7 is a detailed sectional view showing electron gun-moving means according to the fourth embodiment of the invention.

FIG. 7 is an enlarged sectional view schematically showing the structure of the electron gun moving means 21. An opening is formed on the back of the housing 3, and a bearing flange 22 through which the shaft 20 is passed is arranged with the protruded portion thereof engaging the opening on the outer back side thereof. A pressure plate 23 is screwed to the housing 3 to hold the bearing flange 22 between the housing 3 and the pressure plate 23. A gasket 25 is interposed between the housing 3 and the bearing flange 22, and a gasket 24 between the bearing flange 22 and the shaft 20 in a manner to maintain the vacuum hermeticity. In the process, the dimensions of each member are selected appropriately to secure a margin of the gasket 25 sufficient to maintain the vacuum hermeticity while leaving an appropriate clearance between the housing 3 and the bearing flange 22. The peripheral sides of the pressure plate 23 are formed with about four screw holes. The fixed position of the bearing flange 22 can thus be adjusted by pressing the peripheral portion of the bearing flange 22 by turning the adjust screw 26. The other component elements and the functions thereof are similar to those of the corresponding component elements of the third embodiment, and therefore will not be described.

Assume that electron beams are formed by the use of the apparatus constructed as above in accordance with the procedure similar to that for the third embodiment. Since the electron gun 8 mounted on the shaft 20 is freely movable along the direction of electron beam irradiation, the distance between the panel 1 mounted on the apparatus for inspection and the electron gun 8 can be adjusted, so that the phosphor screens of many types of tubes having different pitches between phosphor materials can be inspected with a single electron gun. Also, the fixed position of the bearing flange 22 is adjustable within a plane opposed to the panel, and therefore the center of the panel 1 can be made to coincide with the central axis of the electron gun 8. Further, the free rotation of the electron gun about its axis permits adjustment of displacement in rotational direction between the panel 1 and the electron gun 8. As a consequence, the positional displacement which may occur at the time of mounting the panel 1 as an object of inspection can be compensated for to achieve the perfect landing.

The invention is not limited to the example of the mechanism for moving the electron gun according to the fourth embodiment described above, but may use whatever moving mechanism capable of adjusting the relative positions between the panel and the electron gun.

Although the embodiment relates to the case in which the phosphor screen 2 of the panel 1 is inspected, the invention is not confined to such a case. Instead, the electron gun 8 or the shadow-mask 15, as an object of inspection, is arranged as shown in FIG. 6 and inspected with the other normal component parts.

The first, second, third and fourth embodiments described above may use the electron gun for inspecting the phosphor screen or the shadow-mask. As long as the electron gun 8 is capable of forming electron beams having the properties equivalent to that of the actual cathode-ray tube, such electron gun may be newly fabricated for exclusive use for the inspection purpose. It is, however, most convenient to use the electron gun sealed in the actual cathode-ray tube.

Fifth Embodiment

Now, the fifth embodiment of the invention will be explained specifically with reference to the drawings.

The cathode of the electron gun for the cathode-ray tube is generally an oxide cathode. The oxide cathode is an alkali earth metal covered with an oxide film on the surface of a nickel sleeve, which has the property of low operating temperature as compared with the tungsten hot cathode used for the electron microscope or the like. With regard to barium oxide most commonly used as a cathode material of the electron gun for the picture tube, when it is heated to about 800° C. in vacuum, the barium oxide is dissociated into barium and oxygen, and hot electrons are emitted with the dissociated barium as an irradiator. When using the oxide cathode, it should be noted that a dissociated metal is very active and therefore easily reacts with water or oxygen, if any, thereby deteriorating the electron emission capability.

In the actual cathode-ray tube having the interior of the oxide cathode exhausted and sealed in high vacuum degree, the oxide cathode that has completed the aging is not exposed to the atmosphere. The problem therefore is not so serious. In the inspection apparatus for the phosphor screen or the shadow-mask according to the embodiments of the invention, the interior of the housing is exposed to the atmospheric pressure each time the panel or the shadow-mask is replaced, as the case may be. A method of inspection with a partitioning member in the housing, therefore, may be effective for preventing the deterioration of the oxide cathode which otherwise might be caused by the water content of the atmosphere.

A tungsten cathode having a high reaction resistance as compared with the oxide cathode is sometimes used as the cathode of the electron gun included in the phosphor screen inspection apparatus. The tungsten cathode is easily oxidized when heated to high temperature and exposed to the atmosphere. The tungsten oxide is easily evaporated as compared with a single-metal tungsten, and the consumption of the cathode is thus promoted. It is therefore necessary, after inspection, to wait until the cathode temperature sufficiently decreases before exposure to the atmosphere. This method, however, lengthens the time required for each inspection cycle and reduces the inspection efficiency. Even when the tungsten cathode is used, therefore, a partitioning member built in the housing is considered effective means for preventing the deterioration of the cathodes.

The fifth embodiment of the invention will be explained specifically below with reference to the related drawings.

Figure 8:
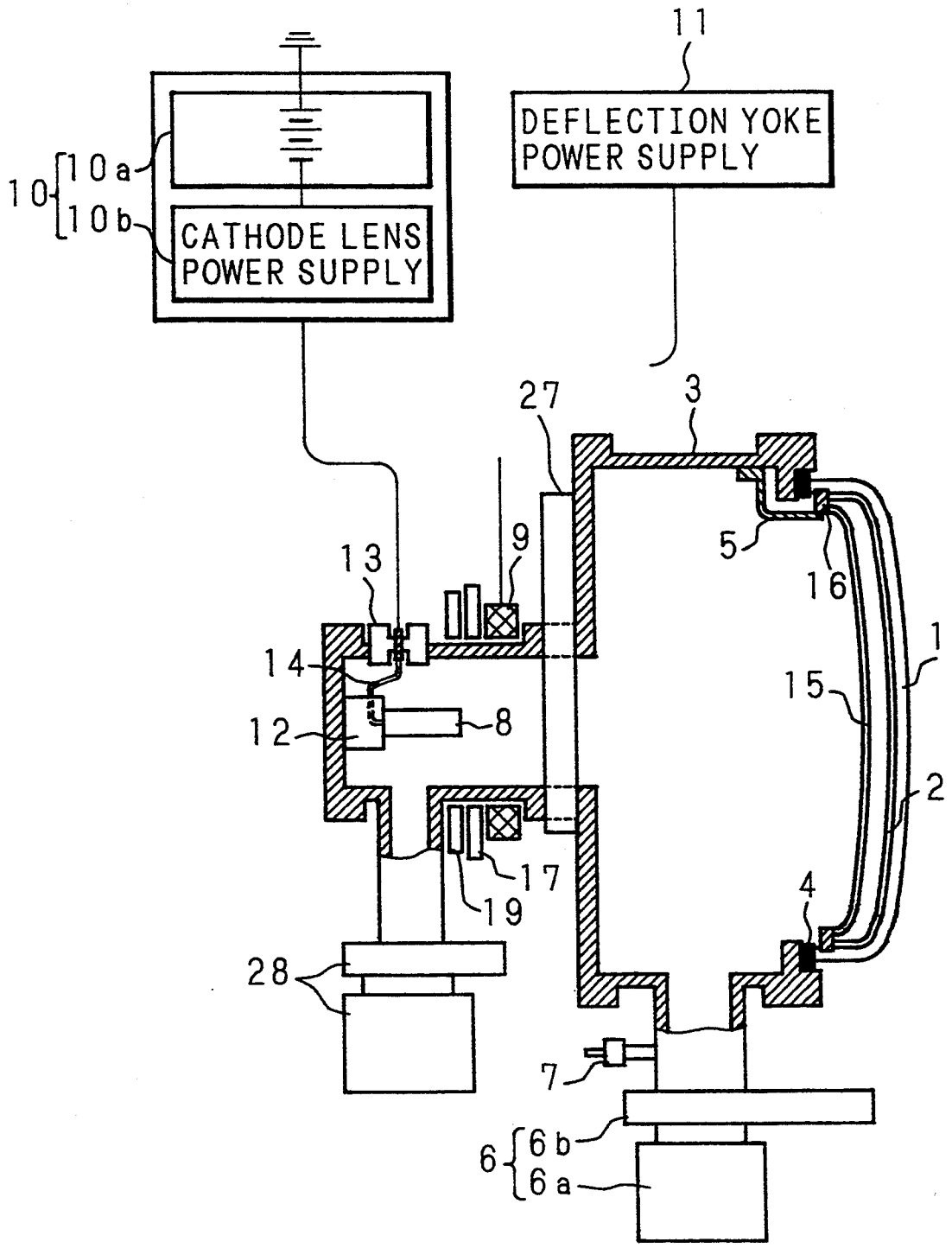
FIG. 8 is a schematic sectional view showing a fifth embodiment of the invention.

FIG. 8 is a schematic sectional view showing a configuration of the apparatus according to the fifth embodiment of the invention. The housing 3 includes a panel mounting/demounting section formed with an opening corresponding to the size of the panel 1 to be inspected and a substantially cylindrical electron gun arrangement protruded in opposed relation to the opening of the panel mounting/demounting section. A gate valve 27 making up a partitioning member is provided at the boundary between the panel mounting/demounting section and the electron gun arrangement. Upon closing of the gate valve 27, the interior of the housing 3 is divided into two areas, the panel-side space and the electron gun-side space, for the purpose of exhaust. The panel-side space and the electron gun-side space of the housing 3 are provided with separate exhaust means 6 and 28 respectively. The other component parts and functions are similar to those of the eighth embodiment respectively and will not explained.

In the apparatus configured as described above, when electron beams are formed in accordance with the same procedure as in the third embodiment, the gate valve 27 is opened and the electron beams drawn from the electron gun 8 are irradiated on the phosphor screen 2 during the inspection of the phosphor screen 2 of the panel 1. When the panel 1 is changed after the inspection, the gate valve 27 and a gate valve **6*b* are closed. Then a leak valve 7 is opened to expose the panel-side space of the housing 3 to the atmospheric pressure. The panel 1 is then removed. In the meantime, the electron gun-side space of the housing 3 is shut off from the panel-side space by the gate valve 27, and therefore is kept at high vacuum degree by the exhaust means 28, thereby preventing the cathodes of the electron gun 8** from being exposed to the atmosphere.

As will be obvious from the foregoing description, according to this embodiment, the panel 1 can be promptly replaced before the cathodes are cooled after inspection. Also, the deterioration of the electron emission capability is suppressed even when an oxide is used for the cathodes of the electron gun 8.

Although the foregoing description of the fifth embodiment concerns the case of inspecting the phosphor screen 2 of the panel 1, the invention is not limited to such an application, but may be used for inspection of the shadow-mask 15 arranged as shown in FIG. 8 using the normal remaining component parts.

Sixth Embodiment

Now, the sixth embodiment of the invention will be explained specifically with reference to the drawings.

Figure 9:
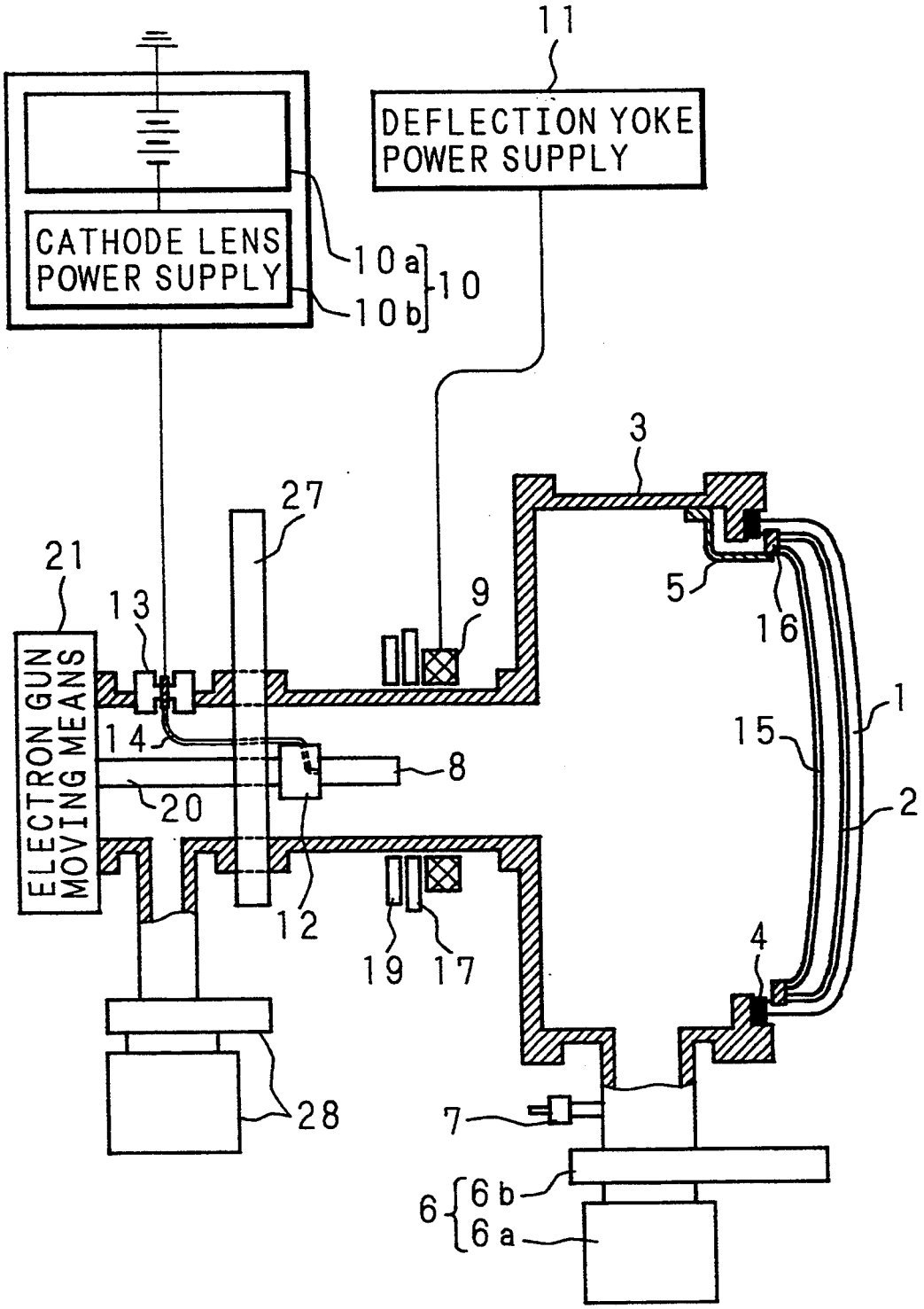
FIG. 9 is a schematic sectional view showing a sixth embodiment of the invention.

FIG. 9 is a schematic sectional view showing a configuration of the apparatus making up the sixth embodiment of the invention. Electron gun moving means 21 is arranged on the back of a housing 3, and electron gun 8 is movable along the direction of electron beam irradiation. A gate valve 27 is disposed at the back side from a predetermined position of the electron gun 8 at the time of inspection. The electron gun moving means 21 causes the electron gun 8 to move toward the back side thereof from the gate valve 27, and the gate valve 27 is closed. Then the interior of the housing 3 is divided into two spaces, the back space and the panel-side space for the purpose of exhaust, by the gate valve 27. Each space has independent exhaust means 6 and 28. The other component parts and the functions thereof are similar to those of the fourth embodiment (FIG. 6) and will not be described.

Assume that electron beams are formed using the apparatus configured as described above in accordance with the same procedure as in the fourth embodiment. The gate valve 27 is opened and the electron gun 8 is advanced to a predetermined position by the electron gun moving means 21 and the electron beams drawn from the electron gun 8 are irradiated on the phosphor screen 2 during the inspection of the phosphor screen 2 of the panel 1. In replacing the panel 1 after inspection is complete, the electron gun 8 is withdrawn toward the gate valve 27 by the electron gun moving means 21. After that, the gate valve 27 is closed, so that the electron gun 8 and the panel 1 are separated from each other for the purpose of exhaust. The back space of the gate valve 27, which is shut off from the panel-side space by the gate valve 27, continues to be kept at high vacuum degree by the exhaust means 28, so that the cathodes of the electron gun 8 withdrawn into this space are prevented from being exposed to the atmosphere.

This configuration is used when the partitioning member formed in the housing 3 as in the fifth embodiment poses an impediment for apparatus configuration. The electron gun moving means 21 may be of any type having the moving function similar to that described above.

Seventh Embodiment

Now, the seventh embodiment of the invention will be specifically explained with reference to the drawings.

Figure 10:
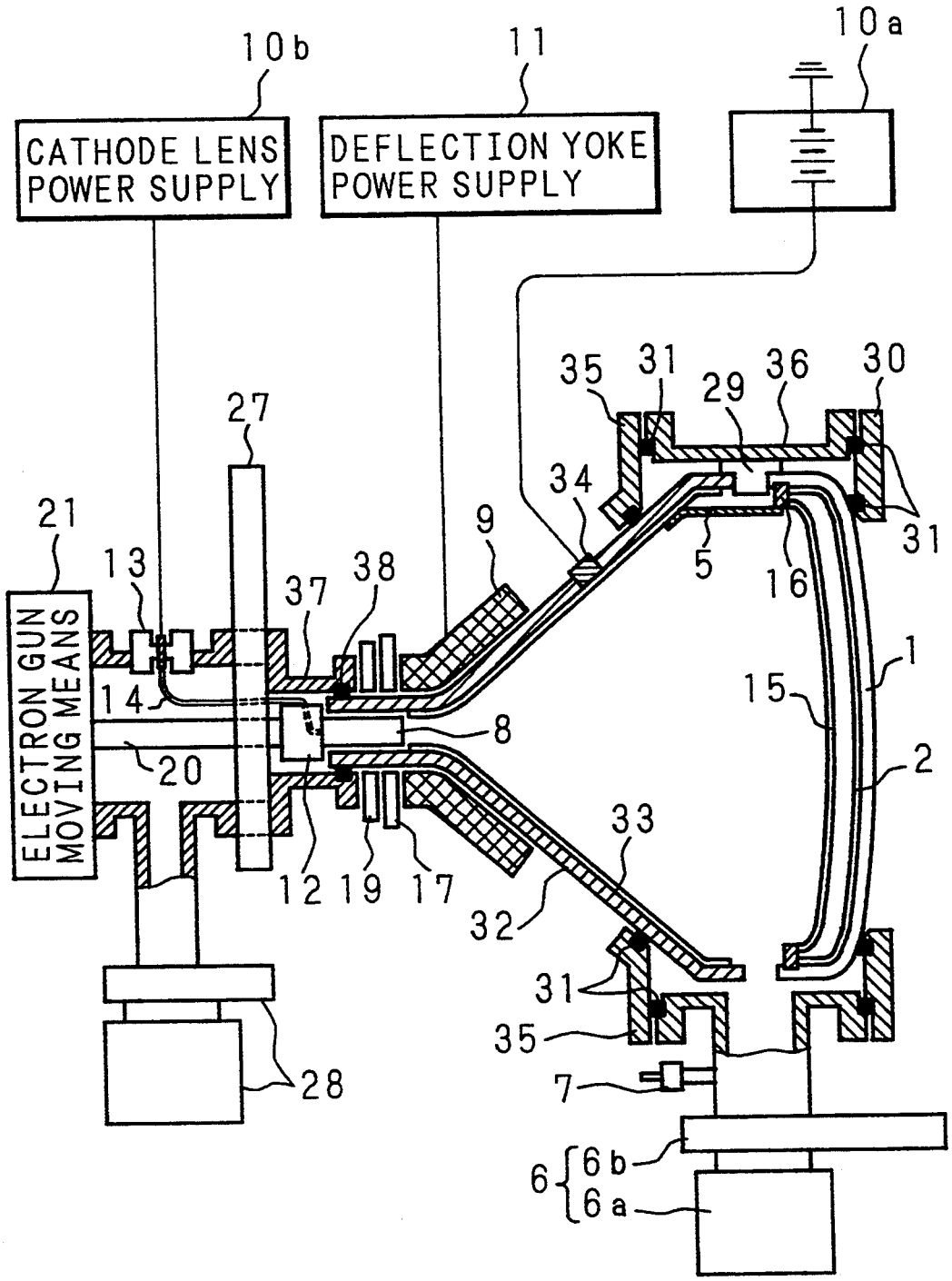
FIG. 10 is a schematic sectional view showing a seventh embodiment of the invention.

FIG. 10 is a schematic sectional view showing the seventh embodiment of the invention. In FIG. 10, numeral 1 designates a panel as an object of inspection fabricated for the color picture tube. A phosphor screen 2 composed of three types of phosphor materials and black matrix is formed on the inner surface of the panel 1. A shadow-mask 15 is mounted using panel pins 16 on the inside of the panel 1. Numeral 36 designates a substantially cylindrical housing of stainless steel. Positioning members 29 of an insulating material are fixed on the inner peripheral surface of the housing 36.

The panel 1 is mounted with the end thereof in pressure contact with the positioning members 29, and has the outer periphery of the face thereof held by a panel pressure plate 30 having an opening. The panel 1 is thus fixed by screwing the panel pressure plate 30 on the housing 36. In the process, in order to maintain the vacuum hermeticity, a rubber gasket 31 is held between the housing 36 and the panel pressure plate 30 and also between the panel 1 and the panel pressure plate 30 respectively. The number of the positioning members 29 is sufficiently enough to support the pressure delivered by the end surface of the panel 1.

The funnel 32 making up the actual cathode-ray tube has the cone side end thereof pressed against the positioning members 29 in opposed relation to the panel 1 at the opening opposite to the opening of the housing 36 having the panel. The cone-side end of the funnel 32 is cut off by the length equivalent to the thickness of the positioning members 29 or otherwise processed in advance to secure an arrangement of the panel 1 and the funnel 32 equivalent to that of the normal complete bulb. The funnel 32, like the panel 1, is fixed in such a way that the outer peripheral portion of the cone of the funnel 32 is pressed by a funnel pressure plate 35 having an opening while the gasket 31 being held, with the funnel pressure plate 35 screwed to the housing 36 while the gasket 31 being held. A conductive film 33 of such a material as graphite is coated on the inner surface of the funnel 32. Also, a shorting plate 5 in the shape of spring plate is mounted on the shadow-mask 15 thereby to electrically short the conductive film 33 and the shadow-mask 15 at the time of mounting the panel 1.

The neck, making up the other end of the funnel 32, is coupled to one end of an electron gun shelter 37 through a gasket 38 in such a manner as to maintain hermeticity. The electron gun shelter 37 is substantially cylindrical in shape and is made of stainless steel, for example. The other end of the electron gun shelter 37 has electron gun moving means 21. The electron gun moving means 21 has the same construction as that shown in FIG. 7 above and therefore will not be explained.

The electron gun moving means 21 is connected to an end of a cylindrical shaft 20 inside of the electron gun shelter 37. The other end of the shaft 20 is fixed with a socket 12 for supporting the electron gun 8 in such a position as to irradiate the electron beams to the panel 1 side. The construction and functions of the electron gun 8 are similar to those explained above with reference to the third embodiment, and therefore will not be explained further. The shaft 20 is adapted to move along the direction of irradiation of the electron beams, whereby the electron gun 8 is also movable.

The housing 36 and the electron gun shelter 37 have exhaust means 6 and 28 respectively therein. The exhaust means 6 coupled to the housing 36 drains the space carrying the electron beam from the clearance between the panel 1 and the funnel 32. The electron gun shelter 37 has a gate valve 27. At the time of replacing the panel 1, the electron gun 8 is withdrawn into the electron gun shelter 37 by the electron gun moving means 21, and the gate valve 27 is closed. Thus the electron gun 8 and the panel-side space are separated from each other for the purpose of exhaust. The leak valve 7 is then opened to expose the panel-side space alone to the atmospheric pressure.

A deflection yoke 9, a purity correcting magnet 17 and a convergence correcting magnet 19 are arranged on the outer periphery of the funnel 32. The deflection yoke 9 causes the electron beams to scan as power is supplied thereto from a deflection yoke-power supply 11. The construction and functions of the purity correcting magnet 17 and the convergence correcting magnet 19 are similar to those of the third embodiment described above and therefore will not be explained.

The electron gun 8 is supplied with power by a wiring member 14 through a lead terminal 13 in the electron gun shelter 37 from a cathode lens power supply **10*b*. On the other hand, an electron beam acceleration voltage is applied to the phosphor screen 2 from an electron beam acceleration power supply 10*a* through an anode contact 34 on the peripheral side of the funnel, the conductive film 33, the shorting plate 5, the shadow-mask 15 and the panel pins 16**.

The phosphor screen inspection apparatus for the cathode-ray tube constructed as described above is used to inspect the panel i as an object of inspection in a manner similar to that for the sixth embodiment. In this apparatus, a part of the housing is composed of a funnel 32, and the panel 1 and the funnel 32 are arranged equivalently to a complete bulb. As a result, not only the electron gun 8 but also the deflection yoke 9, the purity correcting magnet 17 and the convergence correcting magnet 19 are compatible both dimensionally and functionally with the actual cathode-ray tube. The compatibility of the deflection yoke 9 leads also to the compatibility of the deflection yoke power supply 11. Since a high voltage is applied to the phosphor screen 2 as in the actual cathode-ray tube, the power supply for the actual cathode-ray tube can be used directly for the electron beam acceleration power supply **10*a* and the cathode-lens power supply 10*b***.

The use of parts of the actual cathode-ray tube facilitates the manufacture of the apparatus according to the invention.

The seventh embodiment described above is not confined to the case of inspecting the phosphor screen of the panel, but also is applicable to the inspection of the electron gun or the shadow-mask arranged as an object of inspection with the remaining normal component parts.

Apart from the phosphor screen of the panel described above in the first to seventh embodiments, the apparatus according to the invention may equally be used for inspection of the shadow-mask, in which case the panel having the phosphor screen or the electron gun confirmed to be normal beforehand is used, with the phosphor screen irradiated with the electron beams emitted from the electron gun through the shadow-mask to be inspected. In the process, in the case where the shadow-mask is clogged or has such imperfections like an uneven size or pitch of apertures, brightness or color irregularities present themselves on the inspection image displayed. A defect, if any, of the shadow-mask can be detected by observing such irregularities.

In the case of inspecting the electron gun, on the other hand, a panel with a shadow-mask and a phosphor screen already confirmed to be normal are used with the apparatus according to the invention, so that the electron beams drawn from the electron gun to be inspected are irradiated on the phosphor screen. By thus displaying an inspection image, the screen is checked for any defect due to the dimensional error developed during the machining or assembly of the electron gun.

It will thus be understood from the foregoing description that according to the invention, the panel, the electron gun or the shadow-mask is inspected as an object of inspection by irradiating electron beams for scanning the phosphor screen of the panel and thus producing an illuminated image before assembly and manufacture of the component parts of the cathode-ray tube. In this way, it is possible to obtain the result of inspection in advance of subsequent processes, and early detection of a defect, if any, which may occur during the process of forming the phosphor screen is made possible, thereby permitting a remedial measure to be taken at an early time.

Further, in the case where the shadow-mask is an object of inspection, an inspection image is displayed on the phosphor screen formed of a single type of phosphor material. This enables a defect of the shadow-mask to be displayed as a brightness irregularity on the inspection screen, thereby facilitating the decision on the presence or absence of a defect. Furthermore, in regard to the component parts of the cathode-ray tube like the color picture tube for irradiating a plurality of electron beams on the phosphor screen simultaneously in the operation of a complete bulb, the inspection is conducted by bombarding the phosphor material of each color on the phosphor screen with a plurality of electron beams independently of each other. As a result, an image-forming function equivalent to that of a complete product of the actual cathode-ray tube is realized. It is thus possible to conduct inspection of the phosphor screen over as many items as the final product inspection.

In addition, the availability of the means for moving the electron gun facilitates to adjust landing and makes it possible to inspect phosphor screens having different pitches of phosphor materials with a single apparatus without replacing the electron gun.

In the case where the member to be inspected is the panel or the shadow-mask, a partitioning member is interposed between the panel and the electron gun, whereby the member to be inspected can be replaced promptly without waiting until the cathodes of the electron gun are cooled after completion of the inspection, thereby improving the efficiency of the inspection work. Also, the electron emission capacity of the cathode can be prevented from deteriorating, and this results in various superior advantages including a lengthened service life of the electron gun and a reduced frequency of replacing the electron gun.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A method of inspecting a phosphor screen formed on a screen panel used for a cathode-ray tube, comprising the steps of:

preparing an inspection housing which said screen panel is mountable on and demountable from and which is adapted to be enclosed by the mounting of said screen panel thereon, and an electron gun arranged in said inspection housing;

mounting said screen panel on said inspection housing in advance of assembling said cathode-ray tube;

emitting light from said phosphor screen by emitting electron beams from said electron gun; and deciding whether said phosphor screen is defective or not defective from the illuminated condition of said phosphor screen.

2. An inspection method according to claim 1, wherein said electron beams are plural in number.

3. A method of inspecting an electron gun used for a cathode-ray tube, comprising the steps of:

preparing a screen panel formed with a phosphor screen and an inspection housing whose inside said electron gun is mountable on and demountable from and which is adapted to be enclosed with said screen panel;

arranging said electron gun in said inspection housing in advance of assembling said cathode-ray tube;

emitting light from said phosphor screen by emitting electron beams from said electron gun; and deciding whether said electron gun is defective or not defective from the illuminated condition of said phosphor screen.

4. An inspection method according to claim 3, wherein said electron beams are plural in number.

5. A method of inspecting a shadow-mask used for a cathode-ray tube, comprising the steps of:

preparing an electron gun, a screen panel formed with the phosphor screen and an inspection housing whose inside said shadow-mask is mountable on and demountable from and which is adapted to be enclosed with said electron gun and said screen panel;

mounting said shadow-mask in said inspection housing in advance of assembling said cathode-ray tube;

emitting light from said phosphor screen by emitting electron beams from said electron gun; and deciding whether said shadow-mask is defective or not defective from the illuminated condition of said phosphor screen.

6. An inspection method according to claim 5, wherein said electron beams are plural in number.

7. An inspection method according to claim 5, wherein said phosphor screen is formed of a monochromatic phosphor material.

8. An apparatus for inspecting a phosphor screen formed on a screen panel used for a cathode-ray tube, comprising:

an electron gun for emitting electron beams;

an inspection housing including said electron gun therein, which said screen panel is mountable on and demountable from and which is adapted to be enclosed by mounting of said screen panel thereon;

a deflection yoke causing electron beams to scan said phosphor screen; and means for exhausting the interior of said inspection housing.

9. An inspection apparatus according to claim 8, wherein said phosphor screen is formed of plural types of phosphor materials;

said apparatus further comprising a shadow-mask mounted inside said inspection housing for irradiating the electron beams on a predetermined phosphor material.

10. An inspection apparatus according to claim 8, further comprising electron gun moving means for adjusting the position of said electron gun relative to said screen panel.

11. An inspection apparatus according to claim 8, further comprising a partitioning member adapted to be interposed between said electron gun and said screen panel in order to enclose said electron gun in said inspection housing while said screen panel is being demounted.

12. An inspection apparatus according to claim 8, wherein said inspection housing includes a funnel for a cathode-ray tube.

13. An apparatus for inspecting a electron gun used for a cathode-ray tube, comprising:

a screen panel formed with a phosphor screen;

an inspection housing whose inside said electron gun is mountable on and demountable from and which is adapted to be enclosed with said screen panel;

a deflection yoke causing electron beams emitted from said electron gun to scan said phosphor screen; and means for exhausting the interior of said inspection housing.

14. An inspection apparatus according to claim 13, wherein said phosphor screen is formed of plural types of phosphor materials, said inspection apparatus further comprising a shadow-mask mounted inside said inspection housing for irradiating the electron beams on a predetermined phosphor material.

15. An inspection apparatus according to claim 13, further comprising electron gun moving means for adjusting the position of said electron gun relative to said screen panel.

16. An inspection apparatus according to claim 13, wherein said inspection housing includes a funnel for a cathode-ray tube.

17. An apparatus for inspecting a shadow-mask used for a cathode-ray tube, comprising:

an electron gun emitting electron beams;

an inspection housing whose inside said shadow-mask is mountable on and demountable from and which is adapted to be enclosed with said screen panel and said electron gun;

a deflection yoke causing electron beams to scan said phosphor screen; and means for exhausting the interior of said inspection housing.

18. An inspection apparatus according to claim 17, further comprising electron gun moving means for adjusting the position of said electron gun relative to said screen panel.

19. An inspection apparatus according to claim 17, further comprising a partitioning member adapted to be interposed between said electron gun and said screen panel in order to enclose said electron gun in said inspection housing while said screen panel is being demounted.

20. An inspection apparatus according to claim 17, wherein said inspection housing includes a funnel for a cathode-ray tube.

* * * * *